US007760140B2

(12) United States Patent
Kamgaing

(10) Patent No.: US 7,760,140 B2
(45) Date of Patent: Jul. 20, 2010

(54) MULTIBAND ANTENNA ARRAY USING ELECTROMAGNETIC BANDGAP STRUCTURES

(75) Inventor: Telesphor Kamgaing, Chandler, AZ (US)

(73) Assignee: Intel Corporation, Santa Clara, CA (US)

( * ) Notice: Subject to any disclaimer, the term of this patent is extended or adjusted under 35 U.S.C. 154(b) by 727 days.

(21) Appl. No.: 11/449,915

(22) Filed: Jun. 9, 2006

(65) Prior Publication Data

US 2007/0285336 A1 Dec. 13, 2007

(51) Int. Cl.
*H01Q 1/38* (2006.01)
*H01Q 15/02* (2006.01)

(52) U.S. Cl. ..... 343/700 MS; 343/909; 343/829; 343/846; 343/893

(58) Field of Classification Search ..... None
See application file for complete search history.

(56) References Cited

U.S. PATENT DOCUMENTS

| | | | | |
|---|---|---|---|---|
| 4,131,893 | A * | 12/1978 | Munson et al. | 343/700 MS |
| 7,042,419 | B2 | 5/2006 | Werner et al. | |
| 7,126,542 | B2 * | 10/2006 | Mohamadi | 343/700 MS |
| 7,209,082 | B2 * | 4/2007 | Waltho | 343/700 MS |
| 7,310,065 | B2 * | 12/2007 | Anguera Pros et al. | 343/700 MS |
| 7,486,253 | B2 * | 2/2009 | Kondo et al. | 345/1.2 |
| 2002/0167457 | A1 * | 11/2002 | McKinzie et al. | 343/909 |
| 2003/0071763 | A1 * | 4/2003 | McKinzie et al. | 343/909 |
| 2005/0226468 | A1 * | 10/2005 | Deshpande et al. | 382/115 |
| 2006/0112898 | A1 * | 6/2006 | Fjelstad et al. | 119/496 |
| 2006/0125713 | A1 * | 6/2006 | Thevenot et al. | 343/909 |
| 2008/0258993 | A1 * | 10/2008 | Gummalla et al. | 343/876 |

OTHER PUBLICATIONS

International Search Report for corresponding matter P24200PCT dated Nov. 7, 2007.
Fan Yang et al., Microstrip Antennas Integrated with Electromagnetic Band-Gap (EBG) Structures: A Low Mutual Coupling Design for Array Applications, IEEE Transactions Antennas and Propagation, vol. 51, Issue 10, Part 2, Oct. 2003, pp. 2936-2946.
Gardelli et al., EBG Superstrates for Dual Polarized Spare Arrays, Antennas and Propagation Society International Symposium, 2005 IEEE vol. 2A, Jul. 3-8, 2005, pp. 586-589.
Kamgaing, T. et al; Electromagnetic band-gap structures for multiband mitigation of resonant modes in parallel-plate waveguides, Antennas and Propagation Society International Symposium, 2004 IEEE vol. 4, Jun. 20-25, 2004 pp. 3577-3580.
U.S. Appl. No. 11/154,078, filed Jun. 15, 2006, Kamgaing.
U.S. Appl. No. 11/240,305, filed Sep. 29, 2005, Kamgaing.
Kamgaing, T. and Ramahi, O.M., "Electromagnetic Band-Gap Structures for Multiband Mitigation of Resonant Modes in Parallel-Plate Waveguides", *IEEE* 3577-3580, (2004).
International Preliminary Report on Patentability for corresponding matter P24200PCT, mailed Dec. 24, 2008.

* cited by examiner

*Primary Examiner*—Trinh V Dinh
(74) *Attorney, Agent, or Firm*—David L. Guglielmi

(57) ABSTRACT

In some embodiments, a multiband antenna array using electromagnetic bandgap structures is presented. In this regard, an antenna array is introduced having two or more planar antennas situated substantially on a surface of a substrate, a first set of electromagnetic bandgap (EBG) cells situated substantially between and on plane with the antennas, and a second set of EBG cells situated within the substrate below the antennas. Other embodiments are also disclosed and claimed.

19 Claims, 2 Drawing Sheets

MULTIBAND ANTENNA ARRAY USING ELECTROMAGNETIC BANDGAP STRUCTURES

FIELD OF THE INVENTION

Embodiments of the present invention generally relate to the field of antennas, and, more particularly to multiband antenna array using electromagnetic bandgap structures.

BACKGROUND OF THE INVENTION

Today's wireless communication devices, such as laptop computers, require at least two antennas to transmit and receive external signals. As the number of required antennas increases it will be necessary to isolate the antennas from one another. At the same time the size of wireless devices will likely be expected to decrease.

BRIEF DESCRIPTION OF THE DRAWINGS

The present invention is illustrated by way of example and not limitation in the figures of the accompanying drawings in which like references indicate similar elements, and in which.

DETAILED DESCRIPTION

In the following description, for purposes of explanation, numerous specific details are set forth in order to provide a thorough understanding of the invention. It will be apparent, however, to one skilled in the art that embodiments of the invention can be practiced without these specific details. In other instances, structures and devices are shown in block diagram form in order to avoid obscuring the invention.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment. Furthermore, the particular features, structures or characteristics may be combined in any suitable manner in one or more embodiments.

Figure 1:
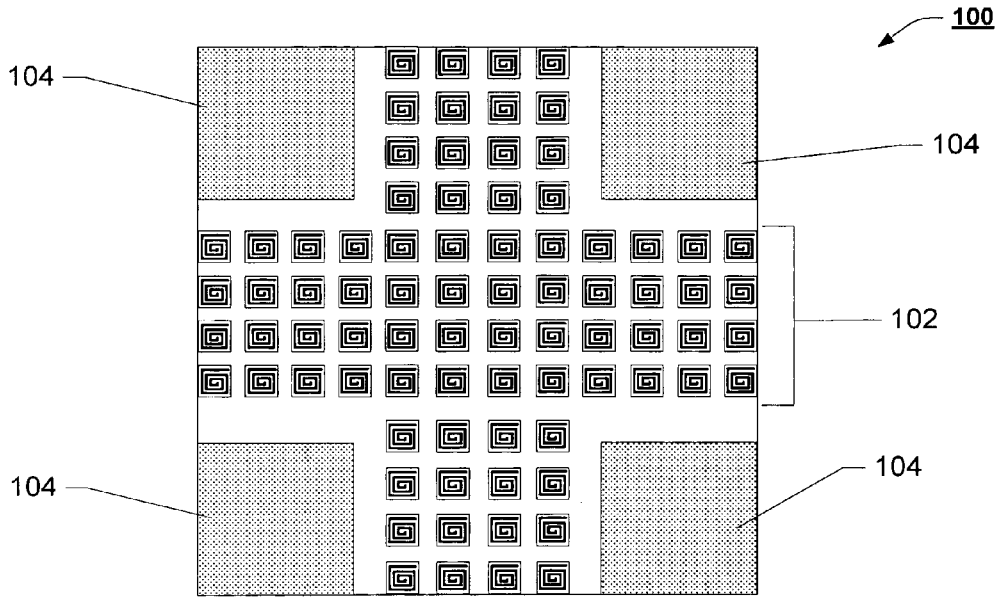
FIG. 1 is a graphical illustration of an overhead view of a multiband antenna array using electromagnetic bandgap structures, in accordance with one example embodiment of the invention.

FIG. 1 is a graphical illustration of an overhead view of a multiband antenna array using electromagnetic bandgap structures, in accordance with one example embodiment of the invention. In accordance with the illustrated example embodiment, antenna array package 100 includes one or more of electromagnetic bandgap (EBG) cells 102 and antennas 104. In one embodiment, antenna array package 100 represents a package comprising a multi-layer organic substrate that is soldered, along with other components, to a printed circuit board.

EBG cells 102 represent multiband EBG structures on the surface of antenna array package 100. EBG cells 102 are designed to prevent radiating waves from propagating between antennas 104. One skilled in the art would recognize that EBG cells 102 can enable small scale antenna arrays by allowing discrete antennas to be located near each other. As shown, EBG cells 102 include a spiral patch, however other topologies or a combination of different topologies may be utilized. As shown, four rows of EBG cells 102 separate adjacent antennas 104, however more or fewer rows may be utilized. EBG cells 102 may have forbidden bandgaps that are customized for the waves to be propagated by antennas 104 by varying the number of turns and trace widths of the spiral patches. In one embodiment, the width of each EBG cell 102 is less than or equal to about 750 um for very low frequencies (~1 GHz).

Antennas 104 represent planar antennas on the surface of antenna array package 100. Antennas 104 transmit signals into free space through radial wave propagation. While shown as containing four antenna in a square pattern, antenna array package 100 may contain any number of antennas in any pattern. In one embodiment, coaxial cable or coplanar waveguide feed the signals into antennas 104. In another embodiment, plated through holes (PTH) transmit the signals to antennas 104. Antennas 104 may transmit the same or different frequencies. Some examples of wireless communication that can use antennas 104 include WiFi, WiMax, Bluetooth, and cellular communications. In one embodiment, antenna array package 100 is part of a multiple inputs multiple outputs (MIMO) radio, where antennas 104 are identical and EBG cells 102 redirect the signals upwards and substantially prevent the signals from propagating sideways.

Figure 2:
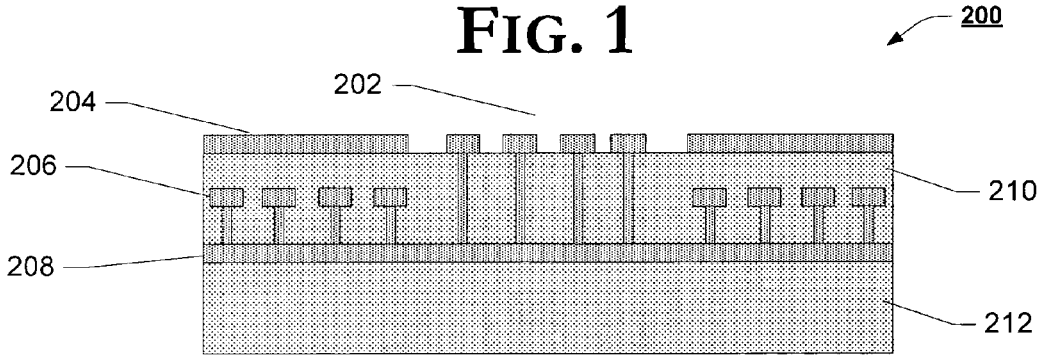
FIG. 2 is a graphical illustration of a cross-sectional view of a multiband antenna array using electromagnetic bandgap structures, in accordance with one example embodiment of the invention.

FIG. 2 is a graphical illustration of a cross-sectional view of a multiband antenna array using electromagnetic bandgap structures, in accordance with one example embodiment of the invention. As shown, antenna array package 200 includes EBG cells 202, antenna 204, EBG cells 206, ground plane 208, and dielectric layers 210 and 212.

EBG cells 202 prevent radiating waves from antenna 204 from propagating to adjacent antennas and vice versa.

EBG cells 206 have a forbidden bandgap in the frequency band of antenna 204. One skilled in the art would recognize that substrate thickness can be less than the quarter wavelength required by traditional planar patch antennas. EBG cells 206 may be the same as or different than EBG cells 202 in size and topology. EBG cells 206 may have one, two, three or more bandgaps below 50 Ghz. In one embodiment, the inductance of EBG cells 206 is varied and enhanced by altering the height of the vias coupling EBG cells 206 with ground plane 208.

Figure 4:
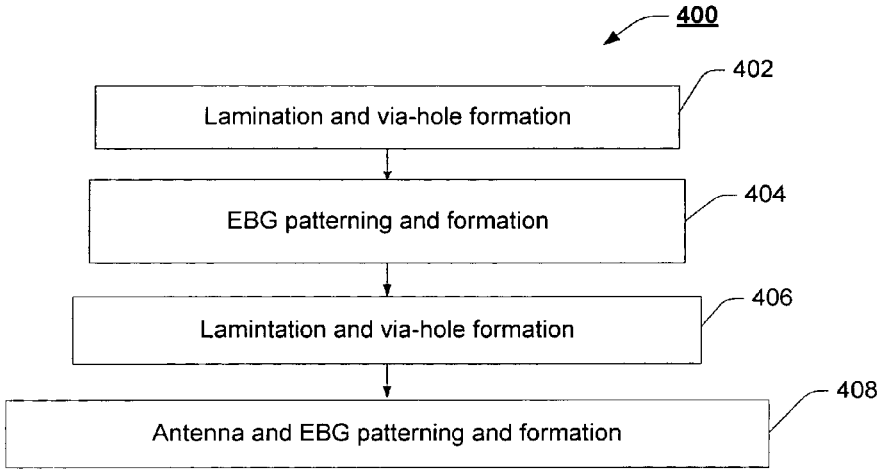
FIG. 4 is a flow chart of an example method for making a multiband antenna array using electromagnetic bandgap structures, in accordance with one example embodiment of the invention.

As part of a process for making a multiband antenna array using electromagnetic bandgap structures, for example as described in reference to FIG. 4, dielectric layers 210 and 212 may be laminated on a core ground plane 208. In one embodiment, ground plane 208 is a metal layer that is coupled with a ground on a printed circuit board and coupled with EBG cells 202 and 206 through PTH's. In one embodiment, dielectric layers 210 and 212 are organic substrate layers.

Figure 3:
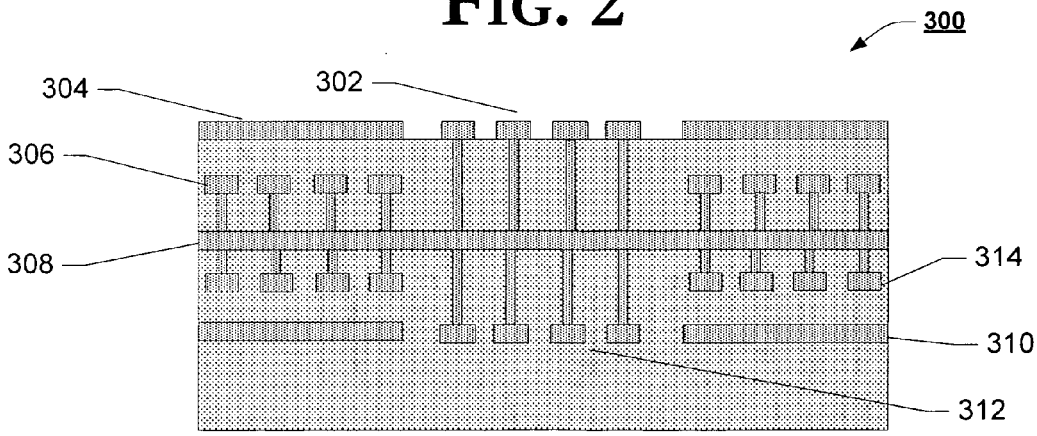
FIG. 3 is a graphical illustration of a cross-sectional view of a multiband antenna array using electromagnetic bandgap structures, in accordance with one example embodiment of the invention.

FIG. 3 is a graphical illustration of a cross-sectional view of a multiband antenna array using electromagnetic bandgap structures, in accordance with one example embodiment of the invention. As shown, antenna array package 300 includes EBG cells 302, antenna 304, EBG cells 306, ground plane 308, antenna 310, and EBG cells 312 and 314.

Antenna array package 300 includes antenna 304 on the surface of, and antenna 310 within, the substrate. By incorporating antenna, and associated grounded EBG cells 312 and 314, within the substrate, it may be possible to implement more antennas without increasing the footprint of the antenna array package.

FIG. 4 is a flow chart of an example method for making a multiband antenna array using electromagnetic bandgap structures, in accordance with one example embodiment of the invention. It will be readily apparent to those of ordinary skill in the art that although the following operations may be described as a sequential process, many of the operations may in fact be performed in parallel or concurrently. In addition, the order of the operations may be re-arranged or steps may be repeated without departing from the spirit of embodiments of the invention.

According to but one example implementation, the method of FIG. 4 begins with lamination (402) and via-hole formation. In one embodiment, a metal substrate core is laminated and utilized as a ground plane, such as, for example as ground plane 208 is laminated by dielectric layers 210 and 212. Via-holes may be created in dielectric layer 210 to allow EBG cells 206 to be grounded to ground plane 208.

Next, EBG cells are patterned and formed (404). In one embodiment, photoresist patterns and electroplating is used to create the spiral patches of EBG cells 206. In another embodiment, EBG cells 206 are preformed and are placed on the substrate.

Next, there is further lamination and via-hole formation (406). Via-holes may be created in dielectric layer 210 to allow EBG cells 202 to be grounded to ground plane 208. Via-holes may also be created to feed a signal to antenna 204 to be transmitted.

Lastly, antennas and EBG cells are patterned and formed (408). In one embodiment, photoresist patterns and electroplating is used to create antenna 204 and the spiral patches of EBG cells 202. In one embodiment, antenna 204 and EBG cells 202 are preformed and are placed on the substrate. Additional steps may be needed to complete the package including, for example, adding ball grid array (BGA) contacts.

Figure 5:
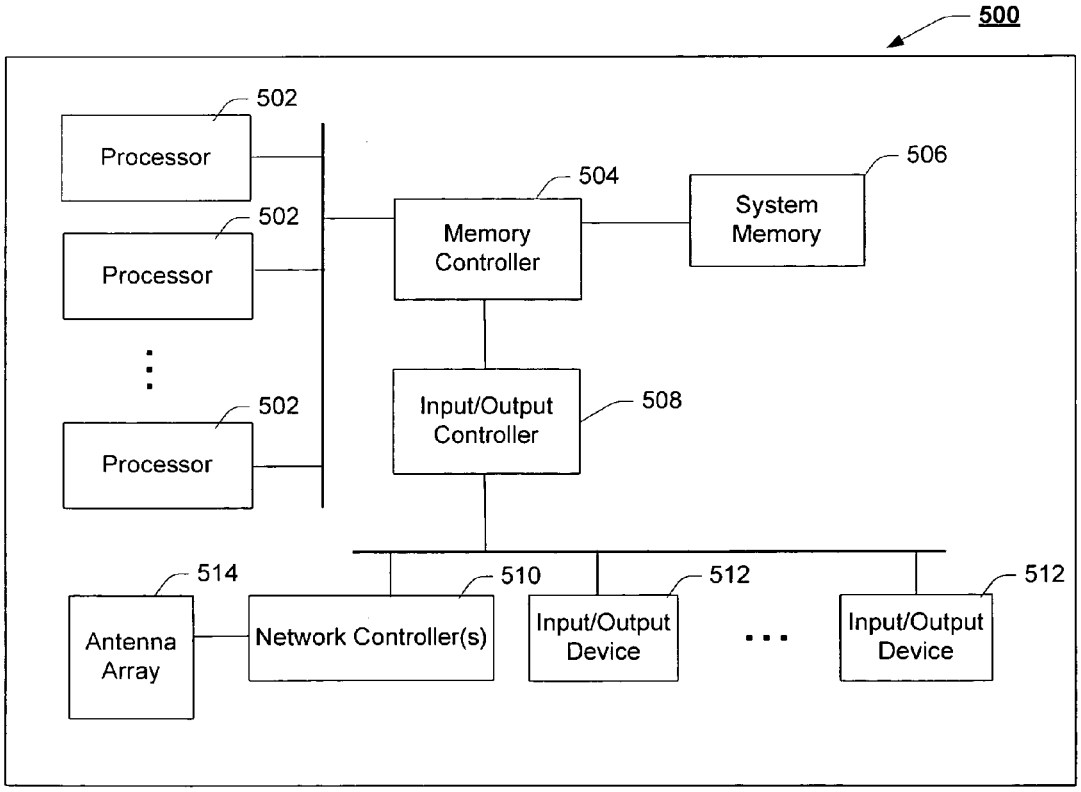
FIG. 5 is a block diagram of an example electronic appliance suitable for implementing a multiband antenna array using electromagnetic bandgap structures, in accordance with one example embodiment of the invention.

FIG. 5 is a block diagram of an example electronic appliance suitable for implementing a multiband antenna array using electromagnetic bandgap structures, in accordance with one example embodiment of the invention. Electronic appliance 500 is intended to represent any of a wide variety of traditional and non-traditional electronic appliances, laptops, desktops, cell phones, wireless communication subscriber units, wireless communication telephony infrastructure elements, personal digital assistants, set-top boxes, or any electric appliance that would benefit from the teachings of the present invention. In accordance with the illustrated example embodiment, electronic appliance 500 may include one or more of processor(s) 502, memory controller 504, system memory 506, input/output controller 508, wireless network controller(s) 510, input/output device(s) 512, and antenna array 514 coupled as shown in FIG. 5.

Processor(s) 502 may represent any of a wide variety of control logic including, but not limited to one or more of a microprocessor, a programmable logic device (PLD), programmable logic array (PLA), application specific integrated circuit (ASIC), a microcontroller, and the like, although the present invention is not limited in this respect. In one embodiment, processors(s) 502 are Intel® compatible processors. Processor(s) 502 may have an instruction set containing a plurality of machine level instructions that may be invoked, for example by an application or operating system.

Memory controller 504 may represent any type of chipset or control logic that interfaces system memory 508 with the other components of electronic appliance 500. In one embodiment, the connection between processor(s) 502 and memory controller 504 may be referred to as a front-side bus. In another embodiment, memory controller 504 may be referred to as a north bridge.

System memory 506 may represent any type of memory device(s) used to store data and instructions that may have been or will be used by processor(s) 502. Typically, though the invention is not limited in this respect, system memory 506 will consist of dynamic random access memory (DRAM). In one embodiment, system memory 506 may consist of Rambus DRAM (RDRAM). In another embodiment, system memory 506 may consist of double data rate synchronous DRAM (DDRSDRAM).

Input/output (I/O) controller 508 may represent any type of chipset or control logic that interfaces I/O device(s) 512 with the other components of electronic appliance 500. In one embodiment, I/O controller 508 may be referred to as a south bridge. In another embodiment, I/O controller 508 may comply with the Peripheral Component Interconnect (PCI) Express™ Base Specification, Revision 1.0a, PCI Special Interest Group, released Apr. 15, 2003.

Wireless network controller(s) 510 may represent any type of device that allows electronic appliance 500 to communicate wirelessly with other electronic appliances or devices. In one embodiment, network controller 510 may comply with a The Institute of Electrical and Electronics Engineers, Inc. (IEEE) 802.11b standard (approved Sep. 16, 1999, supplement to ANSI/IEEE Std 802.11, 1999 Edition). In another embodiment, wireless network controller(s) 510 may also include ultra-wide band (UWB), global system for mobile (GSM), global positioning system (GPS), or other communications.

Input/output (I/O) device(s) 512 may represent any type of device, peripheral or component that provides input to or processes output from electronic appliance 500.

Antenna array 514 may represent a multiband antenna array using electromagnetic bandgap structures as depicted in FIG. 1, 2, or 3.

In the description above, for the purposes of explanation, numerous specific details are set forth in order to provide a thorough understanding of the present invention. It will be apparent, however, to one skilled in the art that the present invention may be practiced without some of these specific details. In other instances, well-known structures and devices are shown in block diagram form.

Many of the methods are described in their most basic form but operations can be added to or deleted from any of the methods and information can be added or subtracted from any of the described messages without departing from the basic scope of the present invention. Any number of variations of the inventive concept is anticipated within the scope and spirit of the present invention. In this regard, the particular illustrated example embodiments are not provided to limit the invention but merely to illustrate it. Thus, the scope of the present invention is not to be determined by the specific examples provided above but only by the plain language of the following claims.

What is claimed is:

1. An antenna array comprising:

two or more planar antennas situated substantially on a surface of a substrate;

a first set of electromagnetic bandgap (EBG) patches situated substantially between and on plane with the antennas; and a second set of EBG patches to limit the propagation of a radiating wave situated within a dielectric material within the substrate below the antennas, wherein the EBG patches are coupled with a grounded metal layer within the dielectric material.

2. The antenna array of claim 1, further comprising four antennas arranged in a substantially square pattern.

3. The antenna array of claim 2, further comprising antennas situated within the substrate.

4. The antenna array of claim 1, wherein the first set of EBG patches comprises spiral-based EBG patches.

5. The antenna array of claim 1, wherein the first set of EBG patches comprises four rows of EBG patches.

6. The antenna array of claim 1, wherein the second set of EBG patches comprises patches having a width of about 750 μm.

7. An apparatus comprising:

a printed circuit board;

a wireless network controller soldered to the printed circuit board; and an antenna array soldered to the printed circuit board, the antenna array comprising:

two or more planar antennas situated substantially on a surface of a substrate;

a first set of electromagnetic bandgap (EBG) patches to limit the propagation of a radiating wave situated substantially between and on plane with the antennas, wherein the first set of EBG patches are coupled with a grounded metal layer within a dielectric material within the substrate; and a second set of EBG patches situated within the dielectric material below the antennas.

8. The apparatus of claim 7, further comprising four antennas arranged in a substantially square pattern.

9. The apparatus of claim 8, further comprising antennas situated within the substrate.

10. The apparatus of claim 7, wherein the first set of EBG patches comprises spiral-based EBG patches.

11. The apparatus of claim 7, wherein the second set of EBG patches comprises patches having a width of about 750 μm.

12. An electronic appliance comprising:

a wireless network controller;

a system memory;

a processor; and an antenna array, wherein the antenna array includes two or more planar antennas situated substantially on a surface of a substrate, a first set of electromagnetic bandgap (EBG) patches to limit the propagation of a radiating wave situated substantially between the antennas; and a second set of EBG patches situated within a dielectric material within the substrate below the antennas, wherein the EBG patches are coupled with a grounded metal layer within the dielectric material.

13. The electronic appliance of claim 12, further comprising four antennas arranged in a substantially square pattern.

14. The electronic appliance of claim 13, further comprising antennas situated within the substrate.

15. The electronic appliance of claim 12, wherein the first set of EBG patches comprises spiral-based EBG patches.

16. The electronic appliance of claim 12, wherein the first set of EBG patches comprises four rows of EBG patches.

17. A method comprising:

forming two or more planar antennas substantially on a surface of a package substrate;

forming a first set of electromagnetic bandgap (EBG) patches to limit the propagation of a radiating wave substantially between the antennas;

forming a second set of EBG patches within a dielectric material within the substrate below the antennas; and forming metal layers within the dielectric material which serve as ground planes coupled with the EBG patches.

18. The method of claim 17, further comprising forming four antennas arranged in a substantially square pattern.

19. The method of claim 17, further comprising forming a multi-layer organic substrate.

* * * * *